US007837388B1

(12) United States Patent
Hefner et al.

(10) Patent No.: US 7,837,388 B1
(45) Date of Patent: Nov. 23, 2010

(54) MULTI-MATERIAL VERTICAL FORM, FILL AND SEAL BAG

(75) Inventors: Corbett T. Hefner, Antigo, WI (US); Scott Erickson, Antigo, WI (US)

(73) Assignee: Plaspack USA, Inc., Antigo, WI (US)

( * ) Notice: Subject to any disclaimer, the term of this patent is extended or adjusted under 35 U.S.C. 154(b) by 1068 days.

(21) Appl. No.: 10/435,752

(22) Filed: May 9, 2003

(51) Int. Cl.
*B65D 30/04* (2006.01)
*B65D 30/20* (2006.01)

(52) U.S. Cl. ..... 383/117; 383/107; 383/109; 383/120

(58) Field of Classification Search ..... 383/117, 383/120, 109, 107, 210; 493/254, 222, 255
See application file for complete search history.

(56) References Cited

U.S. PATENT DOCUMENTS

| | | | |
|---|---|---|---|
| 1,822,948 | A | 9/1931 | Armstrong |
| 1,906,500 | A | 1/1932 | Twitchell |
| 2,056,804 | A | 10/1936 | Potdevin et al. |
| 2,085,365 | A | 6/1937 | Israel |
| 2,298,421 | A | 10/1942 | Salfisberg |
| 2,668,769 | A | 2/1954 | Schlienz |
| 2,689,678 | A | 9/1954 | Wendt |
| 2,774,402 | A | 12/1956 | Wikle |
| 2,853,225 | A | 9/1958 | Bauer |
| 3,015,918 | A | 1/1962 | Schoen |
| 3,123,279 | A | 3/1964 | Day et al. |
| 3,255,951 | A | 6/1966 | Kay |
| 3,257,915 | A | 6/1966 | Carter et al. |
| 3,279,511 | A | 10/1966 | Griffin, Jr. |
| 3,402,749 | A | 9/1968 | Kinzler |
| 3,506,185 | A | 4/1970 | Christensen |
| 3,554,368 | A | 1/1971 | Nagel |
| 3,611,657 | A | 10/1971 | Inoue et al. |
| 3,646,723 | A | 3/1972 | Meroney |
| 3,721,603 | A | 3/1973 | Takeda |
| 4,074,504 | A | 2/1978 | Greenawalt et al. |

(Continued)

FOREIGN PATENT DOCUMENTS

| | | |
|---|---|---|
| CA | 717366 | 9/1965 |

(Continued)

OTHER PUBLICATIONS

*SORMA—Fruit Packaging & Systems*, http://www.sormaitalia.com/netpack2.htm.

(Continued)

*Primary Examiner*—Robin Hylton
(74) *Attorney, Agent, or Firm*—Boyle Fredrickson, S.C.

(57) ABSTRACT

A multi-substrate sheet for forming an at least partially open mesh fabric bag using a form, fill and seal machine and a bag formed of this sheet are provided. The sheet includes at least one strip formed of an open mesh polymeric fabric and at least one strip formed of a polymeric film. The fabric and film strips are secured to one another to form a web that can be formed into a roll and utilized with a form, fill and seal machine. The bag resulting from the processing of the web by the machine includes a substantial open mesh fabric portion to provide adequate ventilation to the product positioned within the bag and a printable film portion.

19 Claims, 8 Drawing Sheets

U.S. PATENT DOCUMENTS

| | | | | |
|---|---|---|---|---|
| 4,091,595 | A | 5/1978 | Pelster et al. | |
| 4,207,983 | A | 6/1980 | Wolske | |
| 4,274,539 | A | 6/1981 | Rabeneck et al. | |
| 4,279,344 | A * | 7/1981 | Holloway, Jr. | 229/123.1 |
| 4,403,637 | A * | 9/1983 | Rivelles Sabater et al. | 383/9 |
| 4,491,217 | A | 1/1985 | Weder et al. | |
| 4,700,755 | A | 10/1987 | Banys | |
| 4,715,167 | A | 12/1987 | Savigny | |
| 4,988,213 | A | 1/1991 | Mattle | |
| 5,255,497 | A | 10/1993 | Zoromski et al. | |
| D360,797 | S | 8/1995 | Evans | |
| 5,546,732 | A | 8/1996 | Coleman et al. | |
| 5,741,076 | A | 4/1998 | Cammack | |
| 5,771,664 | A | 6/1998 | Recchia, Jr. | |
| 5,799,465 | A | 9/1998 | Townsend | |
| 5,802,817 | A | 9/1998 | Hood | |
| 5,823,683 | A | 10/1998 | Antonacci et al. | |
| 5,882,120 | A | 3/1999 | Bell | |
| 5,912,197 | A * | 6/1999 | Madderom | 442/305 |
| 5,957,583 | A | 9/1999 | DeClements, Jr. et al. | |
| 6,015,373 | A | 1/2000 | Henderson et al. | |
| 6,024,489 | A | 2/2000 | Fox et al. | |
| 6,030,120 | A | 2/2000 | Fox et al. | |
| 6,058,681 | A | 5/2000 | Recchia, Jr. | |
| 6,190,044 | B1 | 2/2001 | Fox et al. | |
| 6,371,645 | B1 * | 4/2002 | Rusert et al. | 383/107 |
| 6,506,429 | B1 | 1/2003 | Recchia, Jr. | |
| 6,534,137 | B1 * | 3/2003 | Vadhar | 428/34.9 |
| 6,767,012 | B2 * | 7/2004 | Sasamoto | 271/3.02 |

FOREIGN PATENT DOCUMENTS

| | | | |
|---|---|---|---|
| DE | 3300573 | | 7/1983 |
| EP | 0 788 974 | | 8/1997 |
| EP | 0 677 450 | | 6/1998 |
| EP | 0 891 927 | | 1/1999 |
| ES | 1 033 033 | | 1/1996 |
| ES | 2 104 493 | | 10/1997 |
| FR | 2 319 485 | | 8/1975 |
| JP | 53-14711 | | 7/1976 |
| JP | 51-106619 | | 8/1976 |
| JP | 59-138540 | | 9/1984 |
| JP | 59-175037 | | 11/1984 |
| JP | 60-24743 | | 2/1985 |
| JP | 07315391 | A * | 12/1995 |
| JP | 09-202336 | | 8/1997 |
| JP | 11 049182 | | 2/1999 |
| JP | 11-180451 | | 7/1999 |
| JP | 2000-085796 | | 3/2000 |
| JP | 2000-128190 | | 5/2000 |
| JP | 2000-142712 | | 5/2000 |
| WO | WO 96 32240 | | 10/1996 |
| WO | WO 99/15418 | | 1/1999 |
| WO | WO 99/58323 | | 11/1999 |
| ZA | 937897 | | 10/1993 |

OTHER PUBLICATIONS

*Automatic Packaging System Videos*, http://www.cmsa.es/ing/producombine.htm.

*Netpack brochure*, NETBAG, (undated), 2 pages.

Appendix A, Photographs (bag manufactured by Volm Bag Inc.). 3 pages (Apr. 16, 2001).

Appendix B, Photographs (bag manufactured by Agrow Fresh), 2 pages (Apr. 16, 2001).

* cited by examiner

MULTI-MATERIAL VERTICAL FORM, FILL AND SEAL BAG

BACKGROUND OF THE INVENTION

1. Field of the Invention

The present invention relates to bags for holding items, and more specifically to bags formed from multi-substrate sheets or webs. The sheets include strips of a polymeric film and a ventilating polymeric mesh connected to one another along a longitudinal seam. The invention additionally relates to a method of simultaneously forming and filling such a bag using a vertical form, fill and seal machine and to the sheet used to form the bag.

2. Discussion of the Related Art

Fruits, vegetables, and other items are often stored and sold in bags in order to offer a number of the items for sale in a single prepackaged configuration. The typical bag is also intended for point-of-purchase use and, therefore, also serves as a marketing material for its contents. It is therefore desirable to configure a bag such that its contents can be viewed by prospective purchasers without opening the bag. A plastic film is ideal for this purpose because it is transparent. It also can easily receive printed indicia that may identify the items, their source, and/or other information. Separate printed labels are also easily adhered to plastic film bags. Because a plastic film is flexible, low cost, and easily heat sealed to itself and other materials, plastic film bags can be manufactured and filled relatively easily and inexpensively.

However, traditional plastic films such as low density polyethylene (LDPE) have relatively low gas permeability. They are therefore poorly suited for storing items that must be exposed to the ambient air or "breathe" in order to prevent premature spoilage. For this reason, many produce items, such as apples, onions, and oranges, were traditionally stored and sold in bags from a woven or knit mesh material, such as a polymeric mesh material, that provides sufficient ventilation to prevent premature spoilage of the produce items contained in the bag. The polymeric mesh allows sufficient air to flow into and out of the bag to properly ventilate the produce contained within the bag and prevent spoilage. The bags are normally formed to have polymeric film strips attached across the top of the bag to form a more reliable seal for the bag and prevent premature opening of the bag, as well as to provide a surface on which printed matter can be located on the bag.

Mesh bags have disadvantages, however. The items stored in the bags cannot be easily seen by prospective purchasers. The side and bottom seams of the bags also tend to be relatively weak because the seams do not contain enough material to strongly bond the edges to one another. Indicia also cannot be easily printed directly onto the mesh material. It is therefore necessary in many instances to apply separate polymeric film strips to ends and/or sides of the bag to reinforce the seam and enclose the bag. A separate film strip may also need to be applied to one side of an all-mesh bag for the purposes of receiving the desired display indicia. However, this separate strip actually hinders the viewing of items in the bag. It also adds to the cost of the bag because it requires an additional manufacturing step for its application or at least the provision of an additional strip-applying station on a bag making machine. A bag having these characteristics is disclosed in Antonacci et al. U.S. Pat. No. 5,823,683, the subject matter of which is incorporated by reference.

Many of the problems addressed above are overcome by so-called "half-and-half" bags. A half-and-half bag has a front panel or "half" formed from a polymeric film and a rear panel or "half" formed from a polymeric mesh material. The mesh half provides ample ventilation for the stored items. The film half can receive printed indicia and also can be easily heat bonded to other film materials. The film material can also be securely heat bonded to itself and to the mesh material. Hence, half-and-half bags combine the advantages of all mesh bags and all film bags.

Half-and half bags are formed in a continuous bag making machine from a pair of sheets formed from a polymeric mesh and a polymeric film, respectively. The sheets are unwound from respective rolls and fed concurrently through a bag making machine in an overlying relationship, where they are heat-bonded to one another at their mating edges. The sheets are then folded over while other strips of the polymeric film are attached to the sheets at appropriate locations. The sheets are then cut into longitudinal strips and sealed at the bottom edge to form an open-topped bag. After the bags are completed, they are shipped to a supplier, who fills the bags with items and closes the bags, often by heat sealing the tops using a sealing strip formed from an extension of the film panel. A half and half bag of this general type is disclosed, e.g, in Fox et al. U.S. Pat. No. 6,024,489, which is herein incorporated by reference. A machine and method for producing a bag of this general type is commercially available from Hudson Sharp.

Of course, making and filling bags in two steps using two different machines adds considerable cost to the end product. In an attempt to reduce this cost, it is also known in the prior art to form a bag from a continuous sheet, fill it with items, and seal its side and bottom edges—all in one operation using a so-called "form, fill, and seal" machine. One such machine and its method of operation are described in Pelster et al. U.S. Pat. No. 4,091,595, incorporated herein by reference. In the Pelster et al. '595 patent, a sheet or net of a polymeric netting is pulled over a hollow tube to form a sleeve, and the bottom of the sleeve is sealed and filled with a number of items. The bottom of the sleeve is then indexed down beneath the tube. The top of the thus-formed bag is then sealed to form a filled polymeric mesh bags. The cost of forming and filling such a bag is considerably less than the combined costs of forming and filling more traditional net bags. However, the resulting bag has all of the disadvantages of a traditional mesh bag, including lack of an indicia-receiving surface and relatively weak seams. Thus, any labeling that is to be placed on the bag must be placed on the bag after sealing of the bag, or on a lower closure that is separately applied to the bag during sealing in order to form a lower seal for the bag in a manner similar to the other prior art mesh bags discussed previously.

Therefore, it is desirable to develop a low cost bag material which is preformed of continuous sheet or web containing one or more strips of a polymeric mesh material and a number of strips of a polymeric film or labeling material. The web should be one that can be converted in a continuous form, fill and seal machine to form a filled bag for sale to a consumer immediately after removal from the machine. It is also desirable that the web be capable of forming a bag that has sufficient seam strength to securely retain a number of items within the bag, even during rough handling of the bag.

SUMMARY OF THE INVENTION

In accordance with a preferred aspect of the present invention, a web for a bag is provided that includes both polymeric mesh and printable polymeric film strips and that can be utilized with conventional or customized form, fill and seal bag making and filling machines.

Preferably, the strips of the polymeric mesh material and the strips of the polymeric film material are heat sealed or otherwise secured to one another in order to form a continuous multi-substrate sheet or web that can be formed and filled in a form, fill, and seal machine to produce a bag having adequate ventilation and labeling capabilities. The form of the sheet can be modified as necessary to include any number or orientation of the polymeric mesh strips and polymeric film strips desired. The strips are secured to one another in an overlapped configuration that enables the film strip to be located completely on the exterior or interior surface of the bag in order to increase the strength of the finished bag.

The sheet so formed can be converted in a conventional or customized form, fill and seal machine such that the sheet will form a bag incorporating 1) one or more mesh material strips to provide adequate ventilation to the items held within the bag, and 2) one or more printable film strips capable of retaining printed material on the bag and permitting easy viewing of the items stored in the bag. The strips of polymeric film and polymeric mesh may be altered in width relative to one another to form various proportions of the overall surface area of the finished bag in order to form bags of different configurations as desired for different uses. The strips of different sheets may also be formed at different locations relative to the longitudinal centerline of the sheets in order to vary the percentage of a given bag that is mesh or film as desired for different uses. Further, depending upon the particular configuration of the mesh and film strips on the sheet, the form, fill and seal machine can be adjusted in its configuration to form the sheet into a bag having one side formed entirely of the mesh material and one side formed entirely of the film material. The formed bag can also be formed to include gussets if desired.

The sheet may also include separate labeling strips applied to the polymeric mesh strips in order to provide additional printing surfaces for the resulting bags.

The invention additionally relates to a method of forming and filling a bag having one or more of the characteristics described above.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

DETAILED DESCRIPTION OF THE PREFERRED EMBODIMENTS OF THE INVENTION

Figure 1:
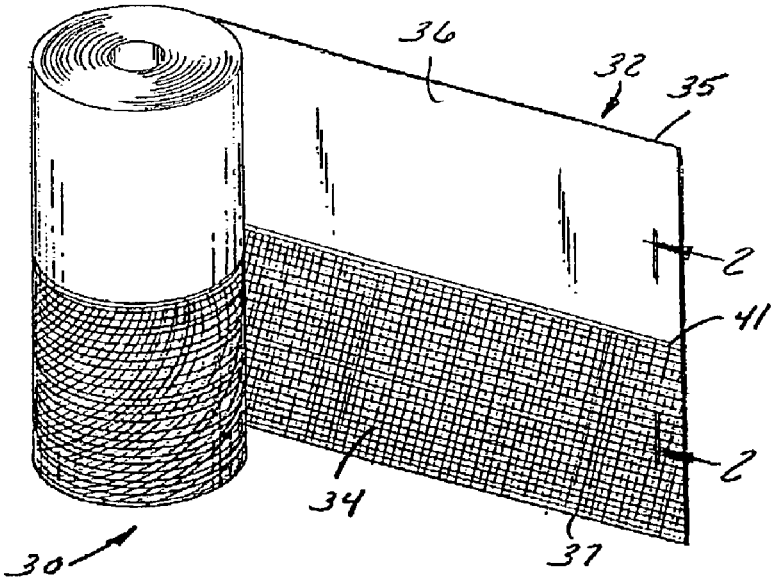
FIG. 1 is a perspective view of a roll formed from a sheet of a multi-substrate material constructed in accordance with a first embodiment of the present invention.

With regard now to the drawing figures in which like reference numerals designate like parts throughout the disclosure, a roll 30 formed from a continuous sheet or web 32 constructed in accordance with a first preferred embodiment of the invention is shown in FIG. 1. The sheet or web 32 is of a multi-substrate construction. It includes a continuous strip 34 of a polymeric mesh material and a continuous strip 36 of a polymeric film material bonded to one another at a seam 41.

The polymeric mesh strip 34 is formed of an open fiber mesh fabric. The open mesh fabric may be formed from any open mesh material to which a thermoplastic film strip can be heat bonded to form a seam that is sufficiently strong for use as form, fill, and seal bags. Preferably, the open mesh fabric also is suitable for processing into bags using high speed bag-making equipment. Woven, knit, scrim, aperated, and extruded net materials are suitable for this purpose and nonwoven fabrics can be used provided they have sufficient openness of construction to allow adequate visibility of a bag's contents. Suitable woven, knit, or scrim fabrics may be formed from tapes or slit-film ribbon yarns. The yarns of the fabric or such yarns and any coatings will generally comprise a thermoplastic resin composition. It also is contemplated to form the fabric or coated fabric from thermoplastic resin compositions having different melting points, with a higher melting resin being present to provide strength and integrity to the fabric and a lower melting resin being present, either as a discontinuous coating on the surface of the fabric or laminated to or as part of the yarns thereof, e.g., as coextruded tapes, to provide for heat bonding of the yarns of the fabric to one another and, in turn, greater dimensional stability and resistance to fraying. Like considerations are applicable to scrims.

Nonwoven netlike fabrics, extruded nets and scrims are also suitable as open mesh fabrics for the mesh fabric strip 34.

These materials typically have a reticulated or netlike structure, with a plurality of interconnected, intersecting fibrils or ribs defining a plurality of open spaces in the fabric. A material suitable for this purpose is commercially available under the brand-name CLAF®, which is a cross-laminated nonwoven fabric made from coextruded film that has been split and stretched. CLAF® material and its characteristics are described in more detail, e.g, in U.S. Pat. Nos. 4,929,303 and 5,182,162. As disclosed in U.S. Pat. No. 4,929,303, the open mesh CLAF® fabric is suitable for joining with other materials, such as papers, films, foils, foams and other materials, by lamination or extrusion coating techniques, or by sewing or heat sealing. CLAF® is available from Nisseki CLAF, Inc., with examples of product designations including CLAF S, CLAF SS, CLAF HS and CLAF MS. Such fabrics are available in various styles and weights. The style designated MS is a preferred fabric for the invented bags. MS style CLAF® has a basis weight of about 18 g/m$^2$ and a thickness of approximately 7.8 mils, as determined by ASTM D3776 and ASTM 01777, respectively.

The polymeric film strip 36 of the web 32 is formed of a suitable synthetic resin film material, preferably a low density polyethylene (LDPE). The thermoplastic film to which the open mesh fabric of the invented bags is heat sealed to form longitudinal seams comprises at least one thermoplastic resin composition having a melting or softening point that is lower than that of the open mesh fabric. In the case of open mesh fabrics composed of two or more resin compositions with different melting temperatures, the film resin preferably melts at a temperature lower than the higher melting component of the mesh fabric. Preferably, the melting point of the film resin is at least about 10° C. below the melting point of the mesh fabric resin of the strip 34 to facilitate heat sealing without melting or softening of the mesh fabric. More preferably, the melting point differential is about 30° C. to about 60° C. The resin of the film should also provide sufficient seal strength and adhesion so that the bags hold product without breaking or failure at or adjacent to the seams during filling, handling and use. Preferably, the open mesh fabric and thermoplastic film are composed of resins and so configured as to provide longitudinal seams having a strength of at least about 5 lb/in$^2$ as measured by ASTM D 5035-95. More preferably, seam strength is at least about 8 lb/in$^2$.

The choice of thermoplastic resin for the film strip 36 depends in part upon the amount of heat and pressure that can be applied thereto at the side seam of the open mesh bag without impacting the integrity of the bag. The resin for the film will also depend on the choice of resin for the open mesh fabric. The thermoplastic resin may be a single resin or a blend of two or more compatible resins. In the case where HDPE is used as the higher melting temperature component of the mesh fabric strip 34, the thermoplastic film strip 36 is preferably formed of an ethylene alpha-olefin polymer or copolymer or blend of compatible polymers having a melting temperature below that of HDPE. The thermoplastic synthetic polymer resins may contain additives such as stabilizers, dyes, pigments, anti-slip agents, foaming agents and the like.

In greater detail, the film strip 36 can be secured to the fabric strip 34 using any technique effective to provide a strong enough bond between the fabric strip 34 and the film strip 36 to stand up to downstream bagmaking steps. Preferably, the film strip 36 is heat sealed to the fabric strip 34 to form the seam 41 using a sealing roller or other film application equipment.

Figure 2:
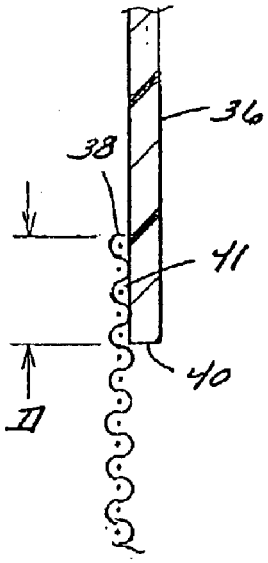
FIG. 2 is a cross-sectional view of the sheet, taken generally along line 2-2 of FIG. 1.

Referring now to FIG. 2, the polymeric mesh strip 34 has an outer edge 35 and a longitudinal edge 38 that is thermally bonded to a corresponding longitudinal edge 40 disposed on the polymeric film strip 36 opposite an outer edge 37 for the film strip 36 such that the mesh strip 34 and film strip 36 overlap one another a specified distance "D" in order to provide the seam 41 with adequate strength to the bond between the strips 34 and 36 such that the web or sheet 32 can function adequately when formed into a bag for storing produce or other items. By securing the mesh strip 34 to the film strip 36 in this configuration, the strength of the bond between the mesh strip 34 and film strip 36 is further enhanced regardless of the amount of overlap due to the integral form of the seam 41. This is because the film strip 36 is softened upon heating to the point where the film strip 36 can surround the overlapped portion of the mesh section 34. When cooled, the mesh strip 34 is contained at least partially within the film strip 36 to form a unitary structure for the seam 41. The width "D" of the overlap can be varied between one-eighth of an inch to one-and-a-half inches, depending upon the particular use to which the sheet 32 will be put. For example, in situations where the sheet 32 will be used to form a bag which will hold heavy items such as grapefruit, the width D will be greater. Conversely, wherein the bag formed from the sheet 32 is configured to hold lighter items such as small onions, the width D will be less. A particularly preferred range of overlap D is between a quarter (¼) inch to one-half (½) inch. Further, the longitudinal edge 38 of the mesh strip 34 is preferably bonded on the surface of the film strip 36 which will constitute an interior surface of the finished bag, such that the edge 38 of the mesh strip 34 cannot be contacted by exterior surfaces and inadvertently separated from the film strip 36.

To thermally bond the heat sealable film strip 36 to the mesh strip 34, the film strip 36 and fabric strip 34 are subjected to sufficient heat and pressure to soften or melt at least the film strip 36 to effect a heat-seal between them. Temperatures and pressures effective to provide the heat-seal will depend in part on the particular thermoplastic film and open mesh fabric used in making the open mesh bag as well as the thicknesses of the film strip 36 and fabric strip 34. The applied heat and pressure, of course, should not be so great as to destroy the integrity of the bag. In a preferred embodiment of the inventive process, wherein a MS grade CLAF® fabric and an ethylene alpha-olefin polymer such as Affinity PF 1140 or blends thereof with polyethylenes for the heat sealable film were utilized, temperatures of about 200° to 450° F., and more typically 300° to 400° F. and pressures of about 15 to 80 psi, and more typically 40 to 60 psi provide an effective heat seal even at short heating times on the order of one-half second or less. In heat sealing the heat sealable film strip 36 and the open mesh fabric strip 34 at the seam 41 to form the sheet 32, any suitable heat seal device can be used. Seal bars could be employed, but a continuous motion sealer, or a heated drum sealer is preferred because they each permit the strips 34 and 36 to be sealed to one another in a continuous process. Other binding, securing, or attachment techniques could also be used in place of heat sealing.

The relative widths and locations of the strips 34 and 36 on the sheet 32 will depend upon the amount of ventilation required and other factors. For example, the respective percentages of the sheet 32 can be between 70% of the mesh strip 34 and 30% of the film strip 36, and 70% of the film strip 36 and 30% of mesh strip 34. In a particularly preferred embodiment, the sheet 32 is formed having 60% of the mesh strip 34 and 40% of the film strip 36. This proportion assures that the front face of a finished non-gusseted bag is formed from film and that the rear face is formed from mesh, leaving an entire face available for printing and viewing while the remainder of the bag is well-ventilated. Instead of or in addition to selecting a particular proportion of mesh and film strips in the sheet 32, it is also possible to select the position of the seam 41 relative to the longitudinal centerline of the web 32 in order to achieve the desired effect. In the illustrated and preferred embodiment, the seam 41 is positioned so that it coincides with and forms a side seam 57 of the finished bags. Other seam locations are also conceivable, however.

Figure 3:
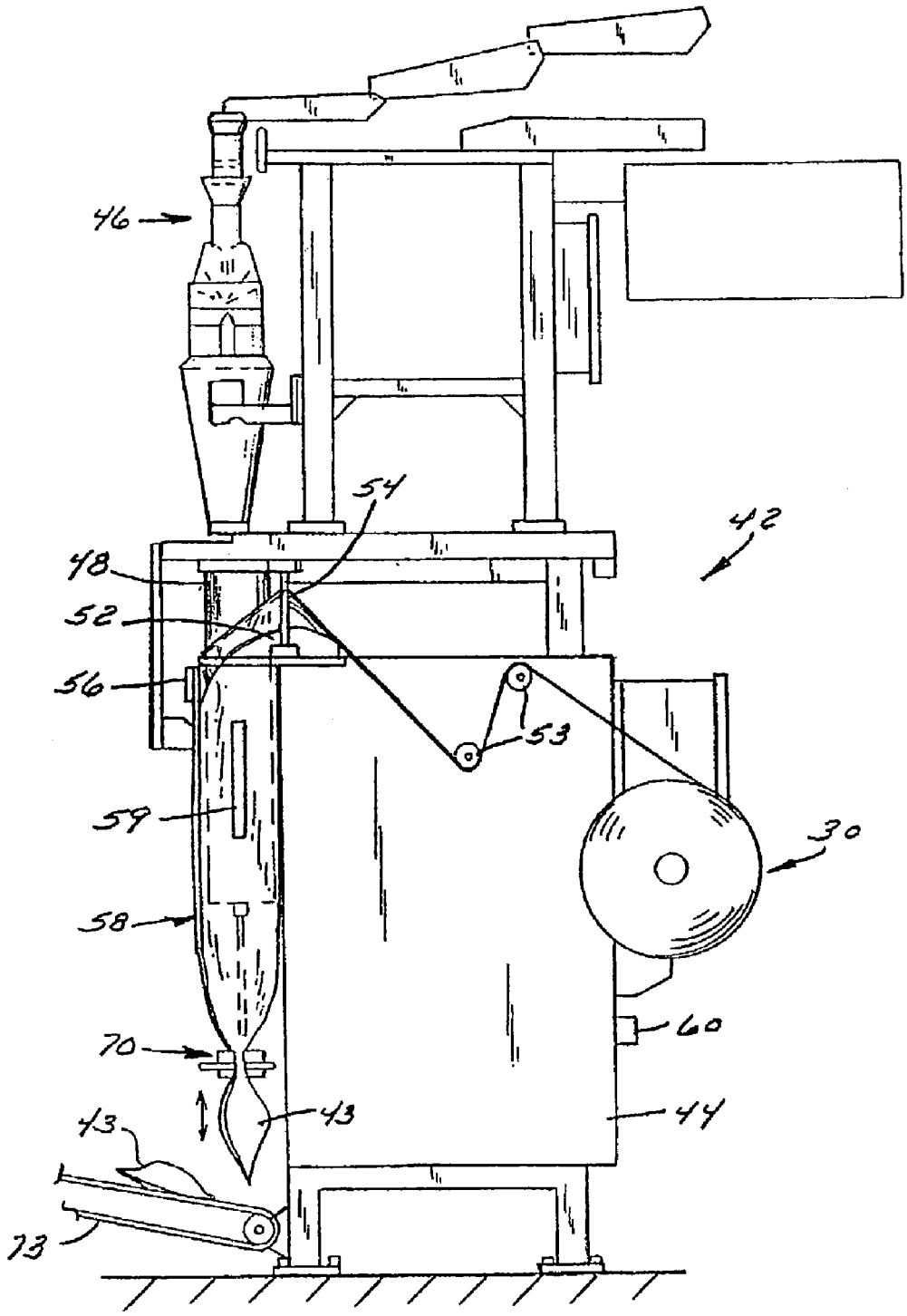
FIG. 3 is a perspective view of a form, fill, and seal bag-making machine that is configured to form and fill bags using the sheet of FIG. 1.
Figure 4:
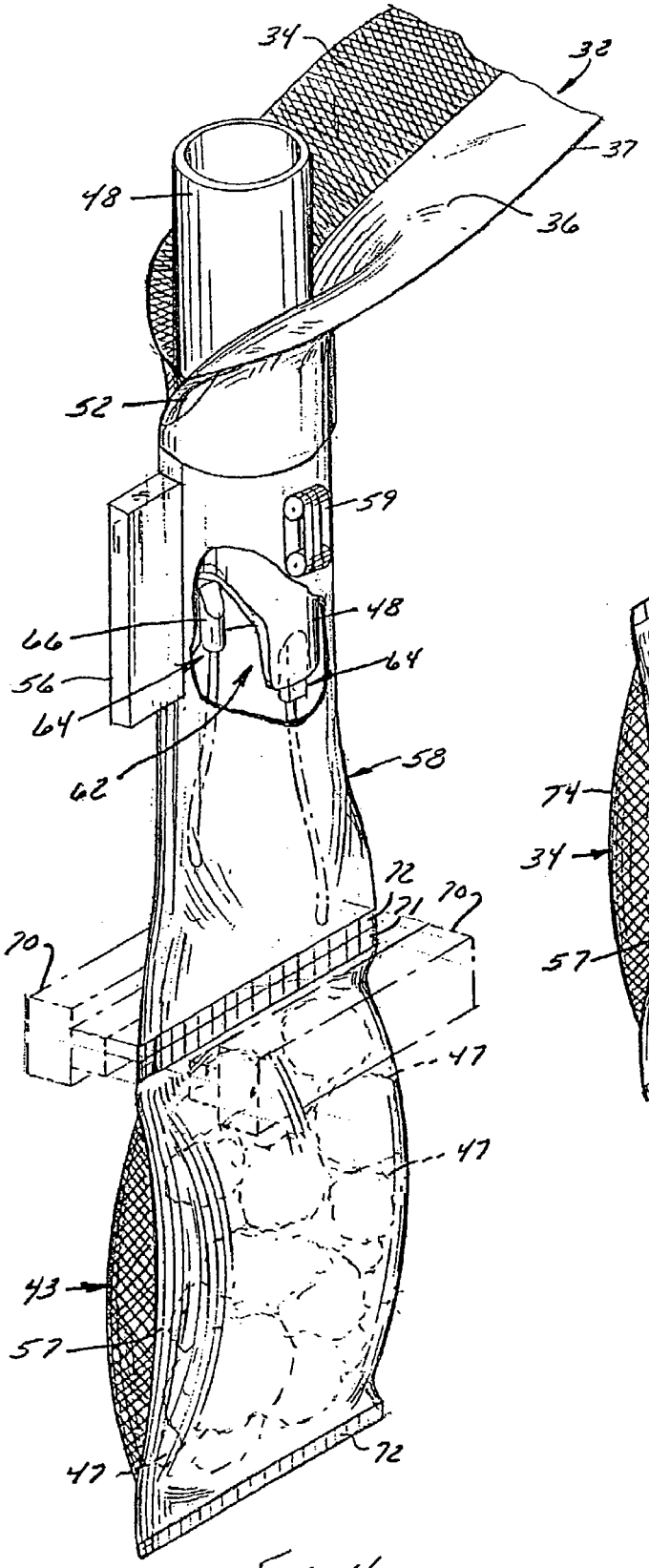
FIG. 4 is a perspective view illustrating the forming, filling, and sealing of a bag from the sheet of FIGS. 1 and 2 using the machine of FIG. 3.
Figure 5:
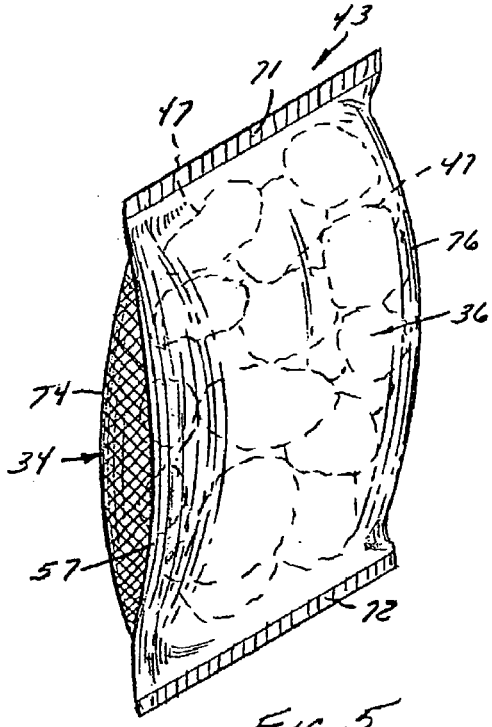
FIG. 5 is a perspective view a bag formed on the machine of FIGS. 3 and 4 using the sheet of FIGS. 1 and 2.
Figure 6:
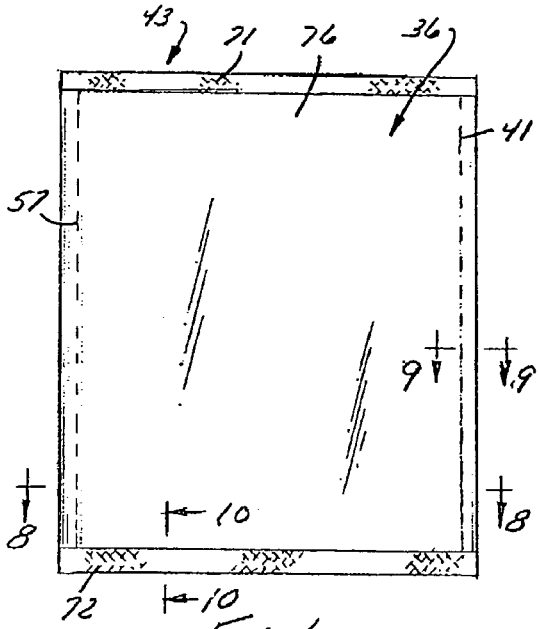
FIG. 6 is a front plan view of the bag of FIG. 5.
Figure 7:
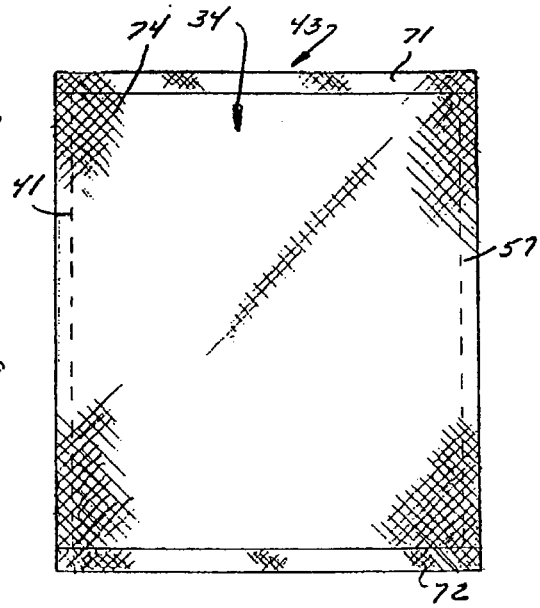
FIG. 7 is a rear plan view of the bag of FIG. 5.
Figure 8:
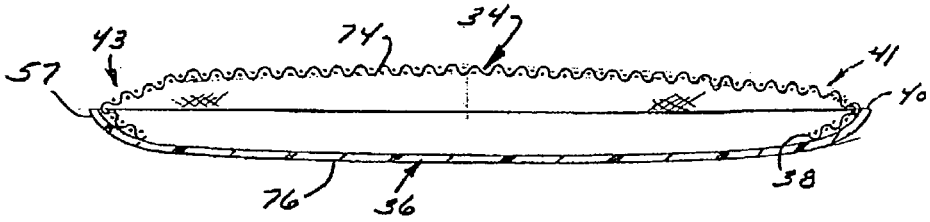
FIG. 8 is a cross-sectional view taken generally along line 8-8 of FIG. 6.
Figure 10:
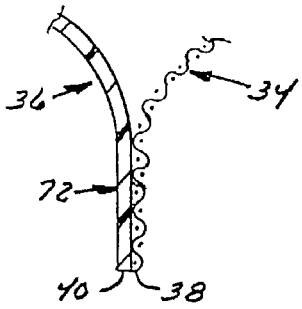
FIG. 10 is a cross-sectional view taken generally along line 10-10 of FIG. 6.
Figure 9:
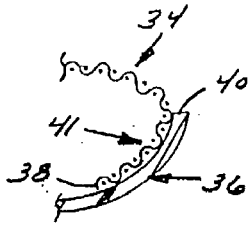
FIG. 9 is a cross-sectional view taken generally along line 9-9 of FIG. 6.

As the sheet 32 is formed, preferably in a continuous process as is known in the art, the sheet 32 is wound onto a core to form a roll 30 that can be utilized with a generally conventional or customized form, fill and seal machine. A variety of machines are available for this purpose including both continuous and intermittent vertical form, fill, and seal machines and continuous and intermittent horizontal form, fill, and seal machines. Currently, the preferred machine used to convert the sheet is an intermittent vertical form, fill and seal machine. Machines of this type are well known in the art, such as the machine disclosed in U.S. Pat. No. 5,255,497, the subject matter of which is hereby incorporated by reference. One such machine 42 is illustrated in FIGS. 3 and 4. The machine 42 includes a frame 44 which supports a roll 30, a product dispenser 46, and a vertical bag forming and filling tube 48. The product dispenser 46 functions to dispense batches of items such as produce items that have been weighed by a computer-weighing apparatus (not shown) at the proper time in the operating cycle of the machine 42. Suitable computer-weighing apparatuses that can perform this function are shown in U.S. Pat. Nos. 4,538,693 and 4,901,807, which are incorporated herein by reference. As is known in the art, the product dispenser 46 receives batches of produce from the weighing machine and dispenses each batch at the appropriate point in the form, fill, and seal cycle to assure that all of the produce in a given batch falls into the associated bag 43 after the bag's sides are formed but before its top is sealed.

The tube 48 is mounted on the frame 44 immediately below the dispenser 46, such that produce 47 dispensed from the dispenser 46 falls through the interior of the vertical forming tube 48 and into a bag 43 positioned beneath the tube 48. The vertical forming tube 48 includes a mounting plate 50 that cooperates with corresponding mounting structures (not shown) on the frame 44 to facilitate convenient and properly aligned mounting of the tube 48 to the frame 44. Looking now at FIGS. 3 and 4, a forming shoulder 52 is secured to the frame 44 by a mounting device 54 located adjacent but spaced from an upper end of the tube 48. As is conventional, the forming shoulder 52 wraps around the upper end of the forming tube 48 and is open at the front end.

Referring again to FIG. 4, the roll 30 described previously is mounted on the frame 44 such that the sheet 32 can be drawn from the roll 30 as the roll 30 rotates. Idler and tensioning rollers 53 are positioned to unwind the sheet 32 from the roll and maintain tension on the sheet as it is drawn from the roll 30 to the forming shoulder 52. A vertical sealing device 56 is supported adjacent the front end of the tube 48 below the front opening of the forming shoulder 52. The vertical sealing device 56 aligns each of the outer edges 35 and 37 of the sheet 32, presses the edges 35 and 37 together in an overlapping fashion, and thermally bonds them together to form an overlap seal resulting in a vertical side seam 57 of a generally tubular sleeve 58. A fin seal could alternatively be formed with a minor modification to the same machine. The device 56 may be a slotted, heated bar as shown, a pair of facing heated bars, or a pair of heated rollers.

Two pairs of advancing belts 59 (only one is shown in FIG. 4) are located on opposite sides of the vertical forming tube 48 for engagement with the sleeve 58. The advancing belts 59 are activated by a controller 60 of the machine 42 at the appropriate point in the machine's cycle to index the sleeve 58 the length of one bag 43 to unroll a corresponding length of the sheet 32 from the roll 30 and into contact with the forming shoulder 52 and the tube 48.

In order to ensure that the top of the sleeve 58 is opened sufficiently wide to receive product 47 dispensed from the product dispenser 46 through the forming tube 48, a spreader attachment 62 is mounted to the lower end of the forming tube 48. As best shown in FIGS. 3 and 4, the spreader attachment 62 includes a pair of spreader fingers 64 mounted to opposite sides of the forming tube 48. Each spreader finger 64 includes a base 66 releasably mounted within the forming tube 48, and an extension 68 extending downwardly and outwardly from the lower end of the forming tube 48. As the sleeve 58 of the web 32 moves downwardly past the lower end of the forming tube 48, the extension 68 of each spreader finger 64 urges the sleeve 58 outwardly such that the sleeve 58 has a sufficient diameter to accept and retain the produce 47 dispensed through the tube 48 by the dispenser 46.

The machine 42 further includes a conventional end sealing and cutting device 70 located below the lower end of the spreader attachment 66. The device 70 is controlled by the controller 60 to horizontally compress the sleeve 58 above the level of the produce 47 and heat the sleeve 58 to simultaneously form a lateral top seam 71 on the bag 43 containing the produce 47 and a lateral bottom seam 72 on the next bag 43 to be filled with the produce 47. The seams 71 and 72 are formed similarly to the seam 57 in that the film strip 36 is softened upon heating and is compressed to surround the aligned portion of the mesh strip 34 to form an integral structure for the seams 71 and 72. The device 70 also includes a blade (not shown) that functions to sever the filled and sealed bag 43 from the remainder of the substrate sleeve 58 such that the filled and sealed bag 43 falls downwardly onto a conveyor 73, which carries the filled and sealed bag 43 to a separate packaging location. A third seal bar (not shown) could be added to or incorporated with the seal bar 70 to form a third lateral seam beneath the seam 71. Punches may be placed in the third seal bar to punch holes between the second and third lateral seams for hanging or carrying the bag.

The form, fill and seal machine 42 as described herein is conventional except for one important difference. Specifically, the end sealing and cutting device 70 is shifted 90° with respect to the design of conventional vertical form, fill and seal machines. By orienting the device 70 in this manner, the top lateral seam 71 and the bottom lateral seam 72 on each bag 43 are located relative to the side seams 41 and 57 such that the mesh strip 34 forms the entire rear of the bag 43, the film strip 36 forms the entire front side of the bag 43, and the side seams 41 and 57 are at the sides of the bag 43 rather than the center. More specifically, looking now at FIGS. 5-10, a finished bag 43 formed utilizing the machine 42 is illustrated. The bag 43 includes a first, rear side 74 formed entirely of the mesh strip 34, and a second front side 76 formed entirely of the film strip 36. The sides 74 and 76 of the bag 43 are secured to one another to close the bag 43 by the vertical seams 41 and 57, the top lateral seam 71, and the bottom lateral seam 72.

Referring now to FIGS. 11-16, a second embodiment of the sheet 132 is illustrated. In this embodiment, a roll 130 of the sheet 132 capable of being used on the machine 42 similar to roll 30 is shown as being formed of a central mesh strip 134 and a pair of outer polymeric film strips 136 disposed on opposite sides of the central mesh strip 134. The central mesh strip 134 and the outer film strips 136 are formed of the same or similar materials as the mesh strip 34 and film strip 36 of sheet 32, and are thermally bonded to one another to form seams 141 along adjacent longitudinal edges 138 and 140, respectively, in the same manner described previously with respect to the sheet 32. Also, the percentages of the mesh strip 134 and the film strips 136 are within the ranges discussed with regard to the sheet 32, with the overall percentage for the polymeric film material divided, preferably generally equally, between the film strips 136.

Figure 12:
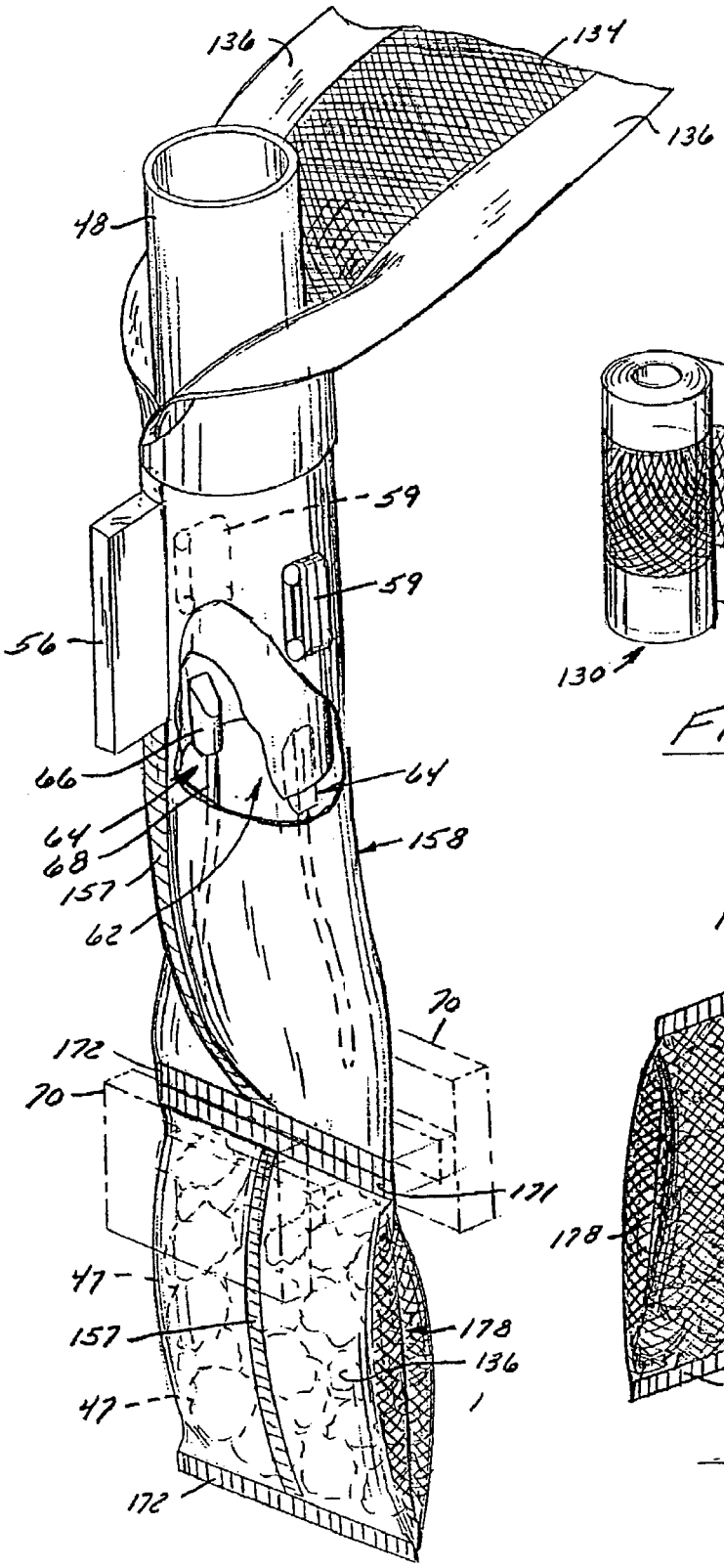
FIG. 12 corresponds to FIG. 4 but illustrates the formation of a bag from the sheet of FIG. 11 using a slightly modified form of the machine illustrated in FIGS. 3 and 4.
Figure 11:
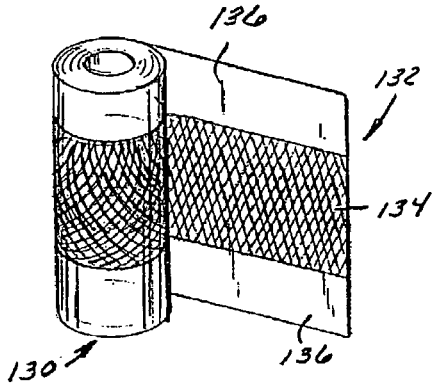
FIG. 11 is a perspective view of a roll formed from a sheet of a multi-substrate material constructed in accordance with a second embodiment of the present invention.
Figure 13:
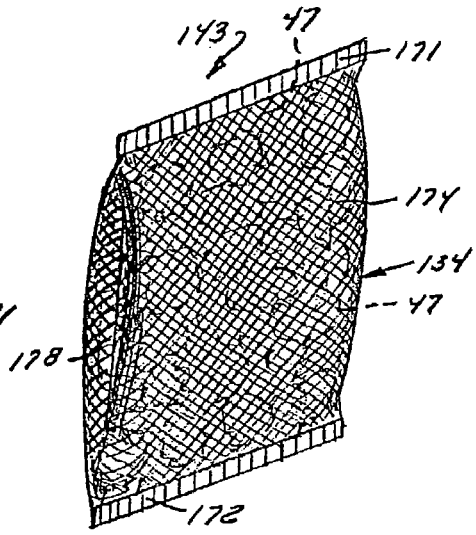
FIG. 13 is a perspective view of a bag formed by the arrangement of FIG. 11.
Figure 14:
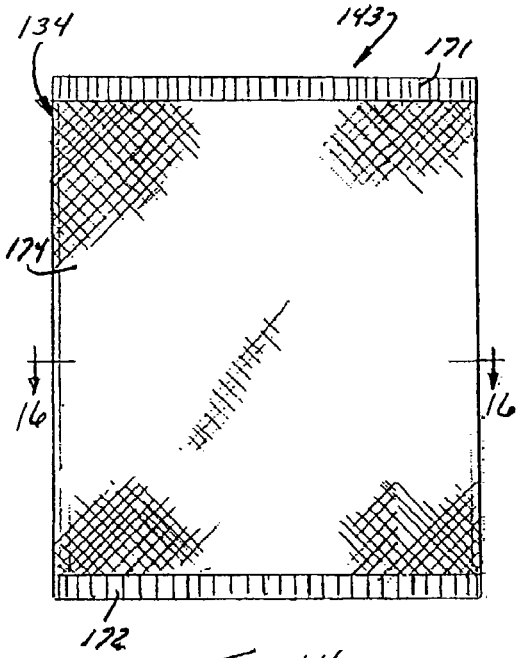
FIG. 14 is a front plan view of the bag of FIG. 13.
Figure 15:
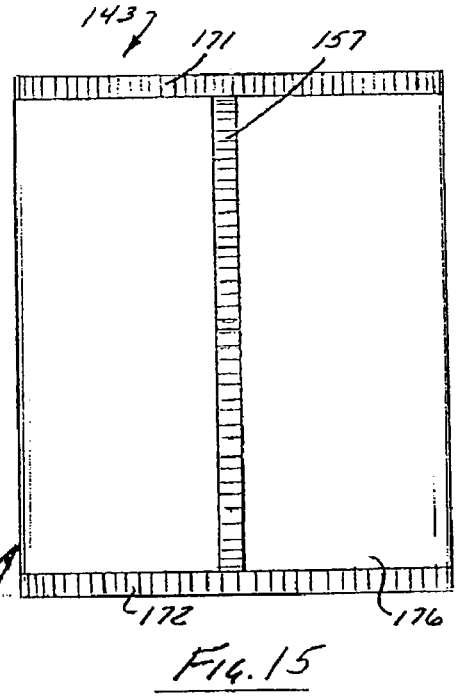
FIG. 15 is a rear plan view of the bag of FIG. 13.
Figure 16:
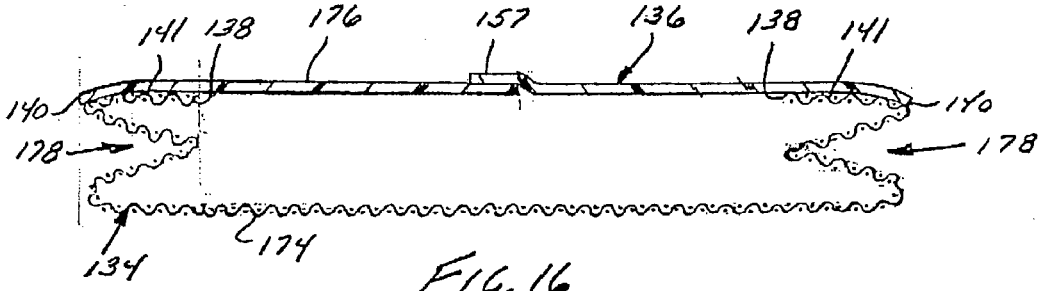
FIG. 16 is a cross-sectional view taken generally along line 16-16 of FIG. 14.
Figure 17:
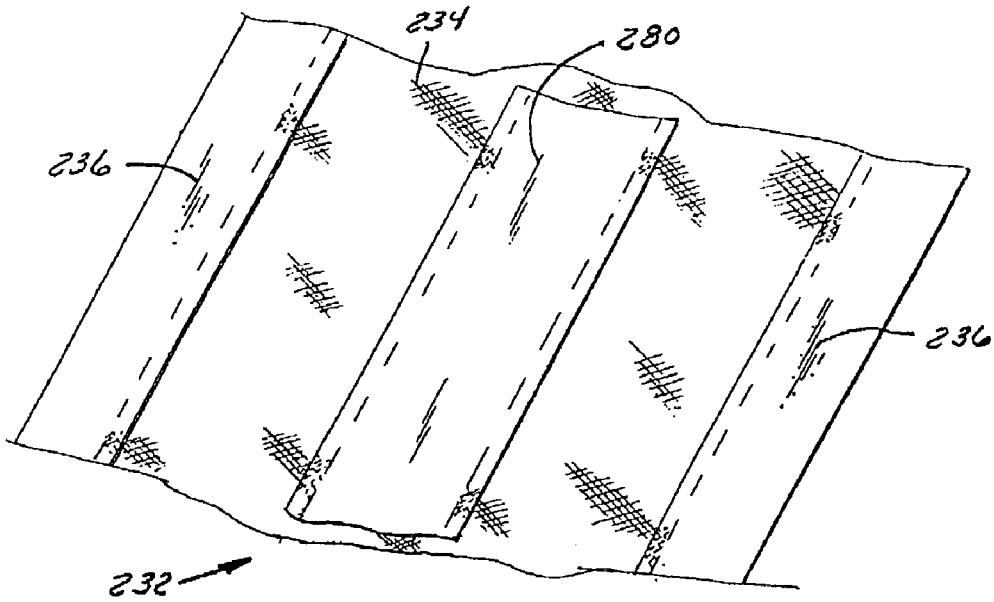
FIG. 17 is a perspective view of a portion of a sheet of a multi-substrate material constructed in accordance with a third embodiment of the invention.
Figure 18:
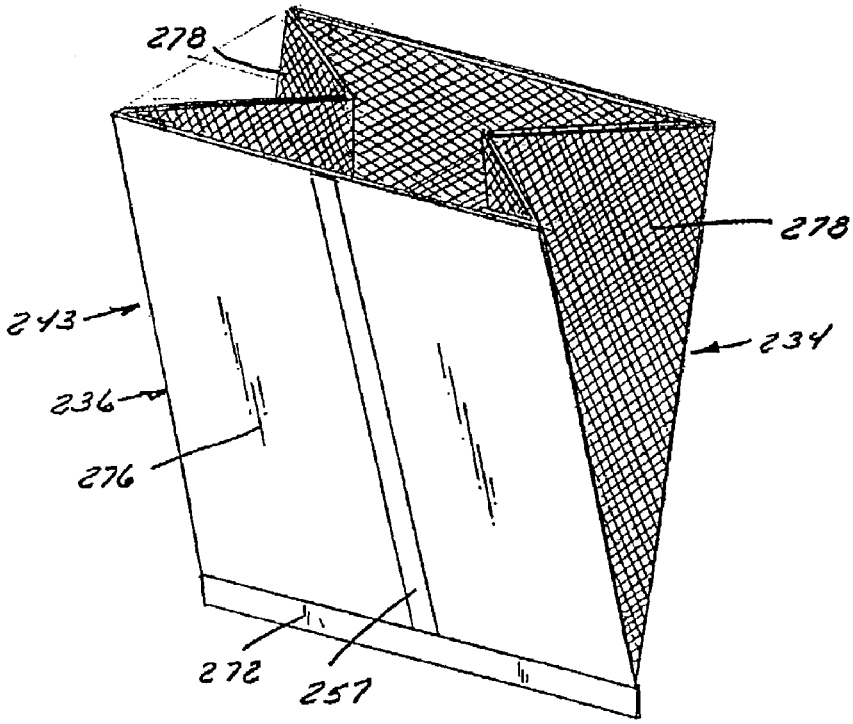
FIG. 18 is a perspective view of an open bag formed utilizing the sheet of FIG. 17.
Figure 19:
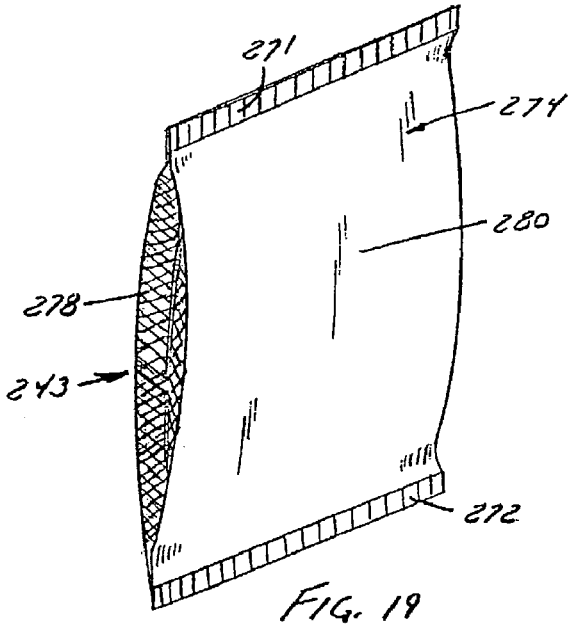
FIG. 19 is a perspective view of the bag of FIG. 18 in a closed configuration.

A bag 143 is formed from the web or sheet 132 by placing the roll 130 of the sheet 132 on the vertical form, fill and seal machine 42 and running the sheet 132 through the machine 42. However, as shown in FIG. 12, in converting the sheet 132 in the machine 42 to form the product-filled bags 143, the end sealing and cutting device 70 is oriented 90° with respect to the position of the device 70 on the machine 42 shown in FIG. 3 back to the conventional position for the device 70 on the machine 42. The sealing and cutting device is oriented in this manner so that, when the sheet 132 is connected in the machine 42, the vertical seam 157 is located on the front face of the bag 143 rather than at an edge. In this reoriented configuration for the device 70, the resulting bag 143 formed by the sheet 132 including the central mesh strip 134 and the outer film strips 136 has a first, rear side 174 formed entirely of the mesh strip 134, a second, front side 176 formed entirely of the joined outer film strips 136. The edges are formed entirely of mesh and, therefore, can be gusseted without interference with seams and without threatening the integrity of the seams. Gussets 178 can be formed on the sides of the bag 143 using a pair of opposed folding mechanisms (not shown), as are well known in the art.

Referring now to FIGS. 17-22, still a third embodiment of the present invention is shown in which a sheet 232 is formed similarly to the sheet 132 including a central polymeric mesh strip 234 and a pair of outer polymeric film strips 236 having longitudinal edges 240 heat-bonded to opposed longitudinal edges 238 of the mesh strip 234 in the manner described previously. However, the sheet 232 also may include an optional strip 280 of a separate labeling material positioned on the mesh strip 234 between and on the same side of the mesh strip 234 as the film strips 236. The labeling material strip 280 is bonded to the central mesh strip 234 in the same manner as the film strips 236 and is also formed of a material similar to, but not necessarily the same as, the film strips 236. It could alternatively be applied to the remainder of the sheet 232 during the form, fill, and seal process.

The sheet 232 can also be formed into a roll (not shown) and converted in the vertical form, fill and seal machine 42 in the same manner as the sheet 132 in order to form a product-filled bag 243 best shown in FIGS. 18-22. The bag 243 is highly similar to the bag 143. It includes a first, front face 276 formed by the vertical seam 257 joining the outer film strips 236 via the vertical sealing device 56 on the machine 42, and a second, rear face 274 formed entirely of the mesh strip 234 and having a pair of gussets 278 joining the sides 274 and 276 and formed entirely from the mesh strip 234. The bag 243 also includes a top lateral seam 271 and a bottom lateral seam 272 formed by the end sealing and cutting device 70 on the machine 42.

Figure 20:
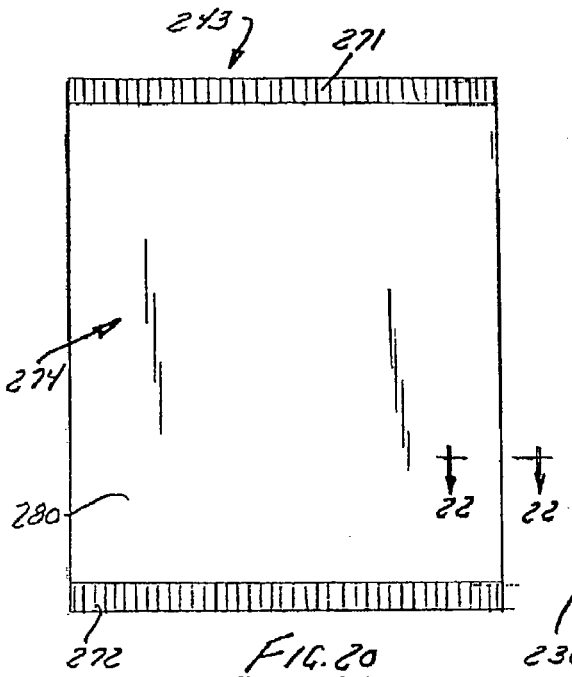
FIG. 20 is a front plan view of the bag of FIG. 19.
Figure 21:
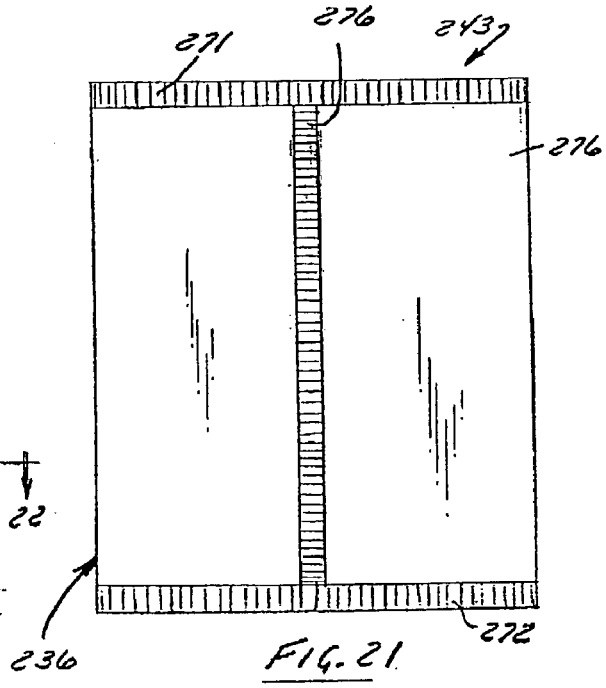
FIG. 21 is a rear plan view of the bag of FIG. 19.
Figure 22:
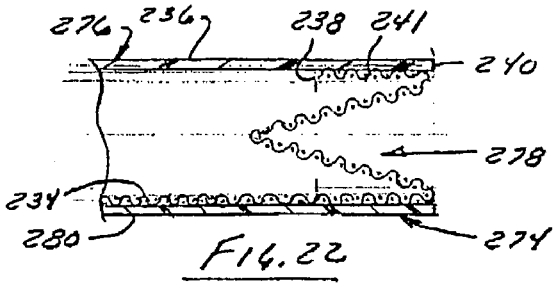
FIG. 22 is a partially broken away cross-sectional view taken generally along line 22-22 of FIG. 20.

Further, as best shown in FIGS. 20 and 22, based on the positioning of the labeling strip 280 in the center of the mesh strip 234, the rear face 274 is formed such that the strip 280 overlays at least substantially the entire length and width of the rear face 274 between the top seam 271 and the bottom seam 272. Therefore, in this embodiment, the sheet 232 enables the resulting bag 243 to be formed with gussets 278 in the polymeric mesh material 234 to enable the contents of the bag 243 to receive adequate ventilation, but also provides two separate printing surfaces on the rear face 274 and the front face 276 of the bag 243 for use as necessary. However, the size of the labeling strip 280 can also be varied in width and/or length to provide additional exposed mesh areas of the rear face 274 to increase the ventilation capable through the bag 243.

As indicated above, the relative widths and locations of the strips of sheets falling within the scope of the present invention may vary significantly from the examples described above. In addition, while webs or sheets have been described having either two or three strip substrates, it should be understood that the invention applies to webs having more than three strip substrates as well. It also applies to webs or sheets having more than two substrates, such as one having a low density film substrate, a polymeric mesh substrate, and a high density film substrate. To the extent that they might not be apparent from the above, the scope of additional variations falling within the scope of the present invention will become apparent from the appended claims.

We claim:

1. A bag having a top end and a bottom end, the bag comprising:

a) a first vertically extending strip formed of an open mesh fabric and having a pair of opposed longitudinal vertically extending side edges;

b) a second vertically extending strip formed of a film of at least one thermoplastic resin, the second strip having a pair of opposed longitudinal vertically extending side edges, an inner surface of one of the side edges of the second strip overlapping an outer surface of a mating side edge of the first strip without being folded over the mating side edge of the first strip and being bonded to the mating side edge of the first strip to form an overlap seal to thereby form a first vertically extending longitudinal seam;

c) a first horizontally extending end seam extending laterally across the top end of the bag and joining the first strip and the second strip; and d) a second horizontally extending end seam extending laterally across the bottom end of the bag and joining the first strip and second strip, the first and second end seams overlapping the first longitudinal seam, wherein at least one entire face of the bag is formed from a film of at least one thermoplastic resin and is formed at least in part from the second strip.

2. The bag of claim 1, further comprising a third vertically extending strip formed of a film of at least one thermoplastic resin, the third strip having a pair of opposed vertically extending longitudinal side edges, the opposed side edges of the third strip being bonded to mating side edges of the first strip and the second strip to form second and third longitudinal seams, respectively.

3. The bag of claim 2, wherein the third longitudinal seam is positioned on a face of the bag.

4. The bag of claim 1, wherein another of the side edges of the first strip is bonded to another of the side edges of the second strip to form a second vertically extending longitudinal seam, the first and second longitudinal seams being positioned at first and second side edges of the bag, respectively.

5. The bag of claim 1, wherein the first strip forms between 30% to 70% of the bag.

6. The bag of claim 5, wherein the first strip forms between 40% to 60% of the bag.

7. The bag of claim 6, wherein the first strip forms 50% of the bag.

8. The bag of claim 1, wherein the bag includes an interior surface and an exterior surface, wherein the opposed side edges of the first strip are positioned on the interior surface of the bag and the opposed side edges of the second strip are positioned on the exterior surface.

9. The bag of claim 8, wherein the mating edges of the first and second strip overlap one another through a distance of between 0.05 inches and 1.50 inches.

10. The bag of claim 1, further comprising a pair of gussets extending between opposite ends of the first end seam and the second end seam.

11. The bag of claim 10, wherein each of the pair of gussets is entirely formed in the first strip.

12. The bag of claim 1, wherein the fabric forming the first strip is a non-woven fabric.

13. The bag of claim 1, wherein the at least one thermoplastic resin forming the film of the second strip has a melting point lower than a melting point of the open mesh fabric of the first strip.

14. The bag of claim 1, further comprising a fourth strip formed of at least one printable thermoplastic resin and bonded to an exterior surface of the first strip at a location spaced from the second strip.

15. The bag of claim 14, further comprising a pair of vertically extending gussets extending between the first end seam and the second end seam, and wherein the fourth strip extends completely over the first strip between the gussets.

16. The bag of claim 15, wherein opposite edges of the fourth strip are spaced inwardly on the first strip from at least one of the gussets.

17. The bag of claim 1, wherein the first end seam and the second end seam are formed by a form, fill and seal machine.

18. The bag of claim 1, wherein the first and second end seams are formed from fin seals in which the inner surfaces of the first and second strips contact and are sealed to one another without either strip being folded over the other strip.

19. A bag having a top and a bottom end, the bag comprising:

a) a first vertically extending strip formed of an open mesh fabric and having a pair of opposed longitudinal vertically extending side edges;

b) a second vertically extending strip formed of a film, the second strip having a pair of opposed longitudinal vertically extending side edges, one of the side edges of the second strip being bonded to a mating side edge of the first strip to form a first vertically extending longitudinal seam;

c) a first horizontally extending end seam extending laterally across the top end of the bag and joining the first strip and the second strip; and d) a second horizontally extending end seam extending laterally across the bottom end of the bag and joining the first strip and second strip, the first and second end seams overlapping the first longitudinal seam, wherein at least one entire face of the bag is formed from a film of at least one thermoplastic resin and is formed at least in part from the second strip, wherein at least one vertically extending seam is formed from an overlap seal in which an inner surface of one of the side edges of one of the first and second strips overlaps an outer surface of a mating side edge of the other of the first and second strips without being folded over the mating side edge of the other strip and is bonded to the mating side edge of the other strip to form an overlap seal, and wherein the first and second end seams are formed from fin seals in which the inner surfaces of the first and second strips contact and are sealed to one another without either strip being folded over the other strip.

* * * * *